US007607537B2

(12) United States Patent
Katsuyama

(10) Patent No.: US 7,607,537 B2
(45) Date of Patent: Oct. 27, 2009

(54) PACKAGING BOX

(75) Inventor: Goro Katsuyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 436 days.

(21) Appl. No.: 10/544,746

(22) PCT Filed: Dec. 20, 2004

(86) PCT No.: PCT/JP2004/019475

§ 371 (c)(1),
(2), (4) Date: Aug. 8, 2005

(87) PCT Pub. No.: WO2005/058715

PCT Pub. Date: Jun. 30, 2005

(65) Prior Publication Data

US 2006/0144746 A1 Jul. 6, 2006

(30) Foreign Application Priority Data

Dec. 18, 2003 (JP) ..... 2003-420576

(51) Int. Cl.
*B65D 85/00* (2006.01)
*B65D 5/00* (2006.01)

(52) U.S. Cl. ..... 206/525; 229/115

(58) Field of Classification Search ..... 206/525, 206/509, 503, 361, 362.4, 525.1, 506, 15.3, 206/580, 321, 229, 583; 229/100, 112, 115, 229/149, 193, 103.11, 240, 117.01–117.35; 383/43; D4/431; 222/105; 399/258, 259, 399/262

See application file for complete search history.

(56) References Cited

U.S. PATENT DOCUMENTS

| | | | | |
|---|---|---|---|---|
| 1,833,974 | A | 12/1931 | Powell et al. | |
| 2,290,359 | A * | 7/1942 | Ringler | 206/362.4 |
| 4,522,487 | A * | 6/1985 | Misawa | 399/102 |
| 4,524,883 | A * | 6/1985 | Herring | 229/117.3 |
| 5,363,959 | A | 11/1994 | Crosby et al. | |
| 5,562,227 | A * | 10/1996 | Takezawa et al. | 229/117.13 |
| 5,836,509 | A * | 11/1998 | Van Loo | 229/112 |
| 6,102,568 | A * | 8/2000 | Davis | 383/43 |
| 6,216,871 | B1 * | 4/2001 | Bacques et al. | 206/497 |
| 6,241,147 | B1 | 6/2001 | Guidera | |
| 6,354,487 | B1 * | 3/2002 | Muise, Jr. | 229/125.28 |
| 6,536,655 | B1 | 3/2003 | Humphrey | |
| 2004/0131392 | A1 * | 7/2004 | Matsumoto et al. | 399/262 |

FOREIGN PATENT DOCUMENTS

| | | |
|---|---|---|
| DE | 40 40 260 A1 | 7/1992 |
| EP | 0 398 225 A1 | 11/1990 |
| JP | 42-25259 | 12/1967 |
| JP | 6-54565 | 7/1994 |
| JP | 3037358 | 2/1997 |

(Continued)

OTHER PUBLICATIONS

Paper Mart. Five Panel Folding Tube Box. Jan. 19, 2001 <http://web.archive.org/web/20010119000500/http://www.papermart.com/>.*

*Primary Examiner*—Bryon P Gehman
*Assistant Examiner*—Ernesto A Grano
(74) *Attorney, Agent, or Firm*—Oblon, Spivak, McClelland, Maier & Neustadt, L.L.P.

(57) ABSTRACT

A packaging box includes a first wall portion (11) and a second wall portion (12) opposed to the first wall portion (12). A shrinkable container (140*a*) filled with the contents is sandwiched between the first wall portion (11) and the second wall portion (12), and the container (140*a*) is held firmly due to a friction between an outer surface of the container (140*a*) and inner surfaces of the first wall portion (11) and the second wall portion (12).

4 Claims, 13 Drawing Sheets

FOREIGN PATENT DOCUMENTS

| | | |
|---|---|---|
| JP | 9-328167 | 12/1997 |
| JP | 10-35655 | 2/1998 |
| JP | 3063919 | 9/1999 |
| JP | 2000-62754 | 2/2000 |
| JP | 2000-109061 | 4/2000 |
| JP | 2000-194182 | 7/2000 |
| JP | 2001-194907 | 7/2001 |
| JP | 3086100 | 3/2002 |
| SE | 514 897 | 5/2001 |
| WO | WO 2005/031471 A1 | 4/2005 |

* cited by examiner

FIG.1A
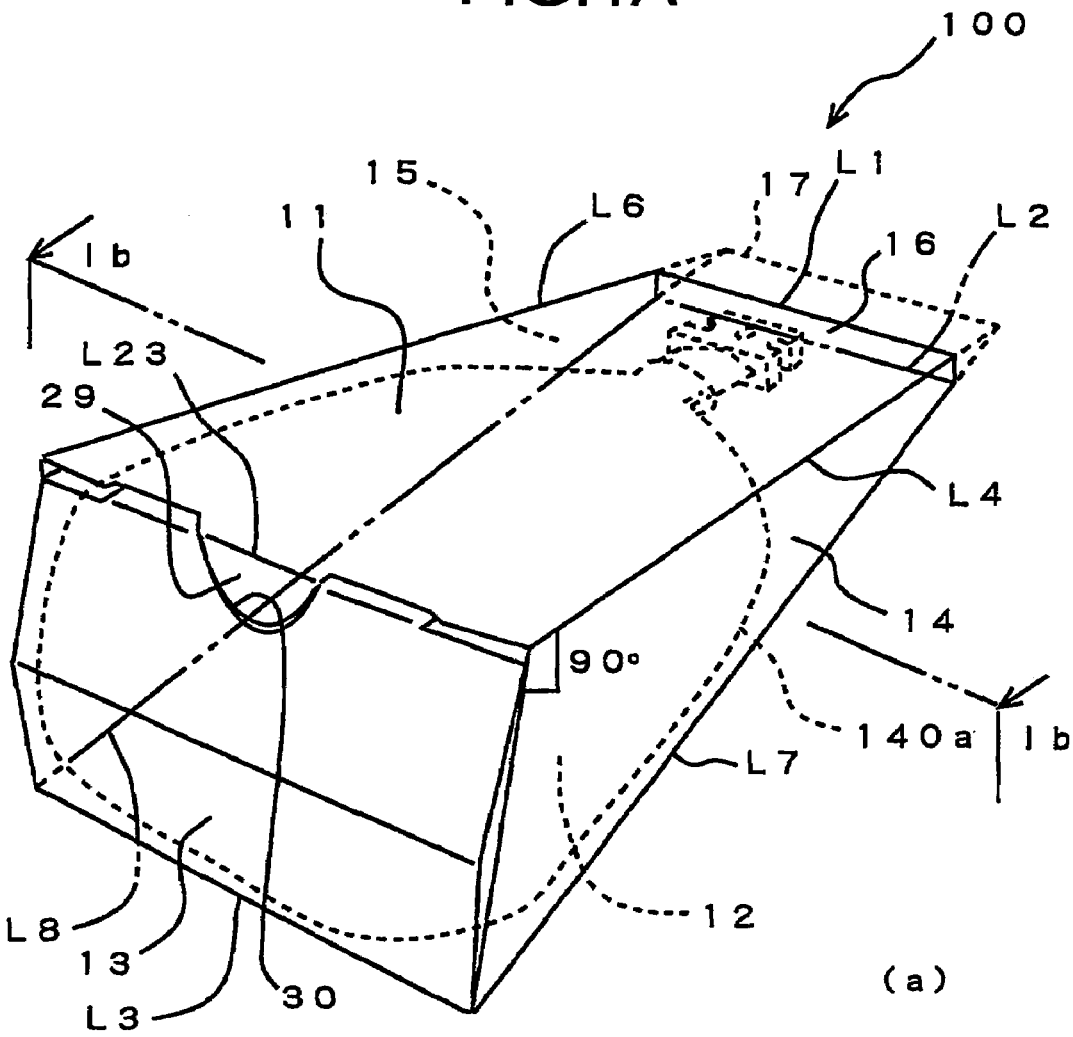
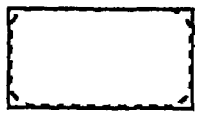
FIG.1B
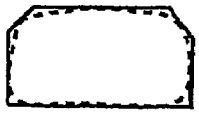
FIG.1C
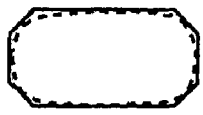
FIG.1D
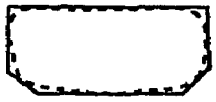
FIG.1E
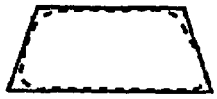
FIG.1F

PACKAGING BOX

TECHNICAL FIELD

The present invention relates to a packaging box that accommodates a shrinkable container filled with contents.

BACKGROUND ART

Some products are accommodated in a container and the container is then packed in a package. Some other products and directly packed in a package. The package can be a box shaped container.

Japanese Utility-Model Laid-Open Publication No. H6-54565 discloses a packaging box for packing precision parts exemplified by photosensitive drums image forming apparatuses. This packaging box includes a cushion material that protects the photosensitive drum from shocks and a box to accommodate the photosensitive drum protected by the cushion material.

Japanese Utility-Model No. 3037358 discloses a tray container for packing food products such as cakes. This tray container includes a bottom member and an openable-closable member that is partially connected to the bottom member and that can be opened and closed as required.

Furthermore, Japanese Utility-Model No. 3086100 discloses a technology to pack posters and/or drawings. The posters and/or drawings are rolled and packed in a triangular-corrugated-cardboard case.

A technique for packing powdery products such as toner is shown in FIGS. 14A and 14B. A container 140*a* for the powdery product is accommodated in a corrugated cardboard box having a rectangular-parallelepiped shape (not shown) together with a cushion material (not shown). The container 140*a* is attached to a proper place in an image forming apparatus such as a copying machine.

The container 140*a* includes a shrinkable container body 141, a funnel-shaped shoulder portion 142 provided on one side (in the drawing, the lower side) of the container body 141, and a neck portion 143 with a toner supply valve provided at a tip (in this case, a lower end) of the shoulder portion 142. These container body 141 and shoulder portion 142 are both made of a shrinkable material (for example, polyvinyl), and the neck portion 143 is made of a hard material (for example, polyethylene terephthalate). Here, 144 denotes a reinforcing plate for reinforcing the container body 141 and having finger holes 145 to prevent the container from falling when a user shakes the container to mix the toner.

FIGS. 15A to 15C are for explaining how the container 140*a* is attached to a copying machine. FIG. 15D is for explaining the recycling of toner.

The user opens a door 151 for toner change provided on a copying machine 150 (FIG. 15A) to remove a vacant container 140*b* (refer to FIG. 14B) from a toner housing portion 152 integrally formed with the door 151 (FIG. 15B), and then inserts the container 140*a* filled with toner in the toner housing portion 152 of the door 151 (FIG. 15C).

The container 140*b* removed from-the copying machine 150 is collected from the user, transported by a transport vehicle 153 to a factory 154, and is then filled with toner at the factory 154. The container 140*a* filled with toner is then transported by the transport vehicle 153 from the factor 154 to users via distributors and the like for sale. That is, the container 140*b* is recyclable.

FIG. 16 is a section view of the copying machine along the XVI-XVI line shown in FIG. 15C. The toner housing portion 152 integrally formed with the door 151 can rotate about a shaft 160. The toner portion housing portion 152 is provided at its bottom with a funnel-shaped protective member 161 for preventing the container 140*a* (refer to FIG. 15C) from compression buckling when inserted with the neck portion at bottom. At the bottom of the protective member, a suction mechanism 162 is provided to fit in the neck portion 143 of the container 140*a* to suck the toner from the toner supply valve.

FIG. 17 is for explaining how the copying machine acquires the toner from the container. A toner 170 in the container 140*a* is sucked via the neck portion 143, the suction mechanism 162, and then a piping 171 to a pump 172. The toner 170 sucked by the pump 172 is then supplied to a photosensitive member (not shown) of the copying machine.

The conventional packaging box has eight major problems apart from various minor problems. The eight major problems are:

1. While the container body is made of a shrinkable and flexible material, the neck portion is made of a hard material, so that, when the container is carried in the packaging box having a rectangular-parallelepiped shape with the neck portion at bottom, compressive buckling of the neck portion occurs, thereby causing a failure when the container is inserted in an image forming apparatus body.
2. The container is an automatic volume-reduction container to be decompressed (sucked) by a pump when inserted in an image forming apparatus. The container expands or shrinks depending on atmospheric pressure and temperature. When the container expands, the wall portion of the packaging box presses the container, thereby making it difficult to extract the container from the packaging box.
3. When the container shrinks due to sucking by the pump, the container gets wrinkled, and some toner remains in the wrinkles.
4. To prevent compressive buckling of the container, a cushion material, such as Styrofoam, is required in the packaging box. Therefore, the cost of such a cushion material and the cost of disposal of the cushion material are incurred.
5. A dead space interferes with efficient transportation and storage of the packaging box.
6. With a rectangular-parallelepiped shape, the packaging box can be arbitrary placed. Therefore, to change the container, the user may have to reverse the container to see descriptions of a container-changing procedure shown on the container. This inhibits a smooth change of the container.
7. Since the packaging box has a rectangular-parallelepiped shape, when a longitudinal direction of the packaging box is oriented in a vertical direction, the neck portion of the container may be oriented downward. In this case, the toner may solidify under its own weight in the container.
8. The packaging box may be deformed to be open due to expansion of the container caused by a drop in barometric pressure when transported by air, exported to a highland (for example, the United Mexican States), or the like.

DISCLOSURE OF THE INVENTION

It is an object of the present invention to solve at least the problems in the conventional technology.

A packaging box according to an aspect of the present invention includes at least a first wall portion and a second wall portion opposed to the first wall portion. A shrinkable container filled with contents can be sandwiched between the first wall portion and the second wall portion whereby the shrinkable container is held firmly between the first wall portion and the second wall portion due to a frictional force between an external surface of the shrinkable container and internal surfaces of the first wall portion and the second wall portion.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 1A is an external perspective view of one embodiment of a packaging box according to the present invention; FIG. 1B is a section view in an Ib-Ib line shown in FIG. 1A; FIGS. 1C to 1F are drawings of exemplary modifications of the packaging box shown in FIG. 1B;

BEST MODE FOR CARRYING OUT THE INVENTION

Figure 2:
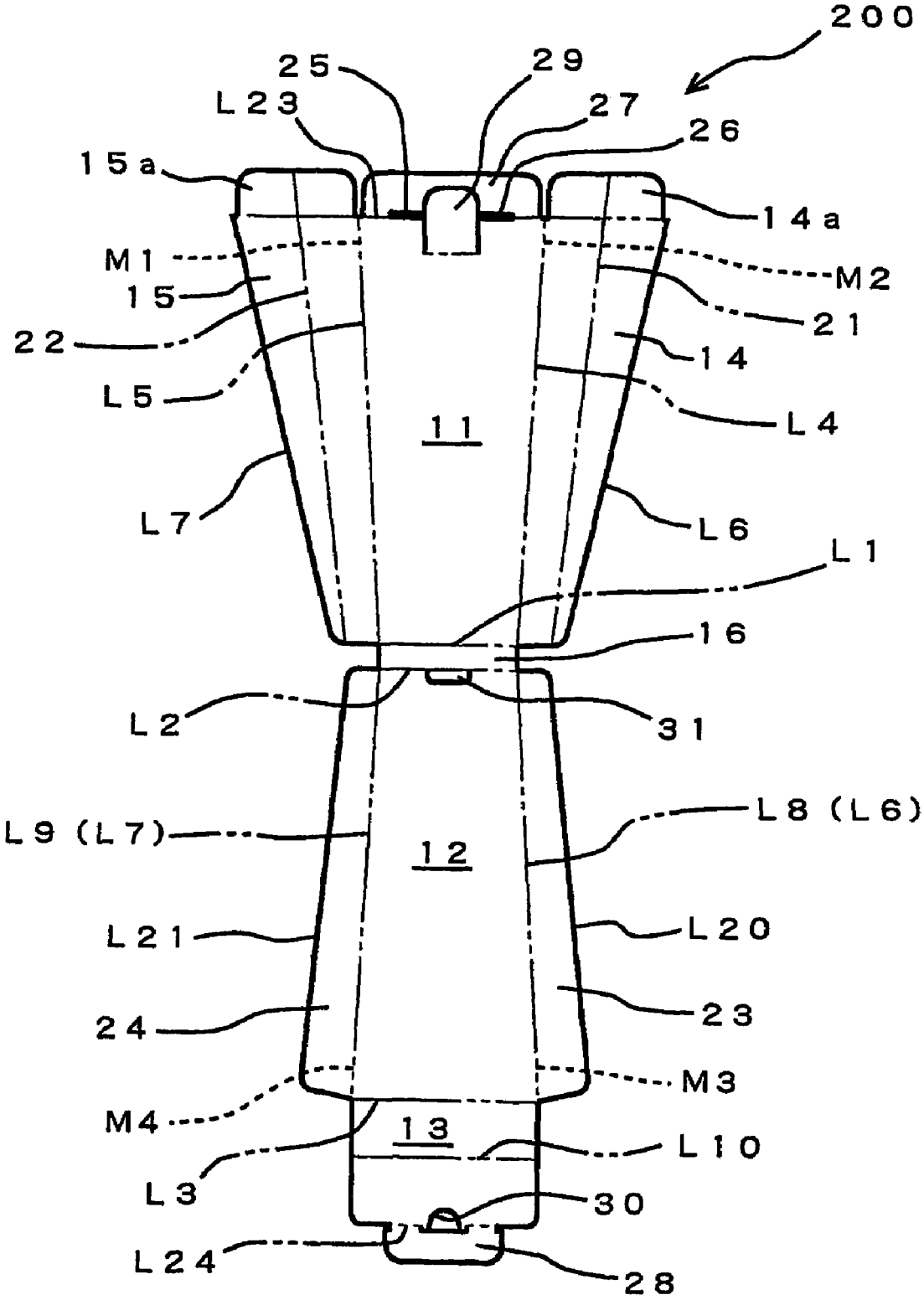
FIG. 2 is a drawing that depicts a net for the packaging box shown in FIG. 1A.

Exemplary embodiments of the present invention are described in detail below based on the drawing.

FIG. 1A is an external perspective view of one embodiment of the packaging box according to the present invention. FIG. 1B is a section view in an Ib-Ib line shown in FIG. 1A. FIGS. 1C to 1F are drawings of exemplary modifications of the packaging box shown in FIG. 1B.

A packaging box 100 shown in FIG. 1A has a prismoid (hexahedron) shape having a first wall portion 11, a second wall portion 12, a third wall portion 13, a fourth wall portion 14, a fifth wall portion 15, and a sixth wall portion 16.

The second wall portion 12 opposed to the first wall portion 11 is tilted toward the first wall portion 11. The third wall portion 13 is opposed to a crossline 17 between an extended plane of the first wall portion 11 and an extended plane of the second wall portion 12 is perpendicular to the first wall portion 11 (in the drawing, the first wall portion 11 and the third wall portion are perpendicular to each other, but this is not meant to restrict the present invention).

The first wall portion 11 and the second wall portion 12 are connected to the fourth wall portion 14 and the fifth wall portion 15 that are opposed to each other. The fourth wall portion 14 and the fifth wall portion 15 form a tapered shape toward the direction of the crossline 17. Near the crossline 17, the sixth wall portion 16 is connected to the first, second, fourth, and fifth wall portions to be opposed to the third wall portion 13.

Figure 14A:
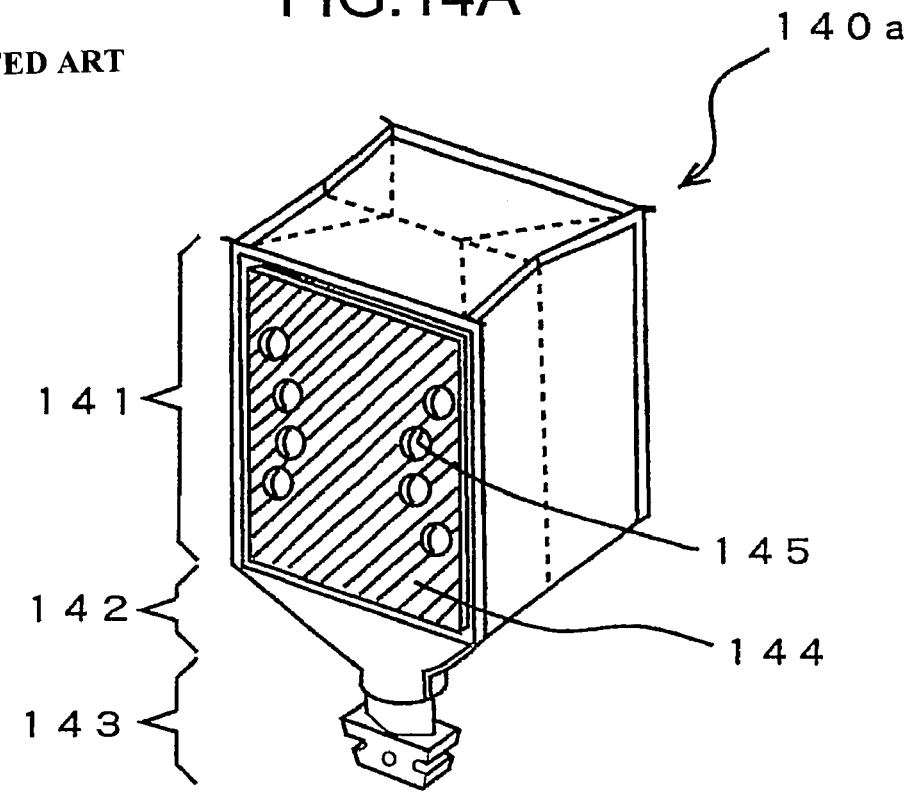
FIG.14A RELATED ART
FIG. 14A is an external perspective view of a container filled with contents.
Figure 14B:
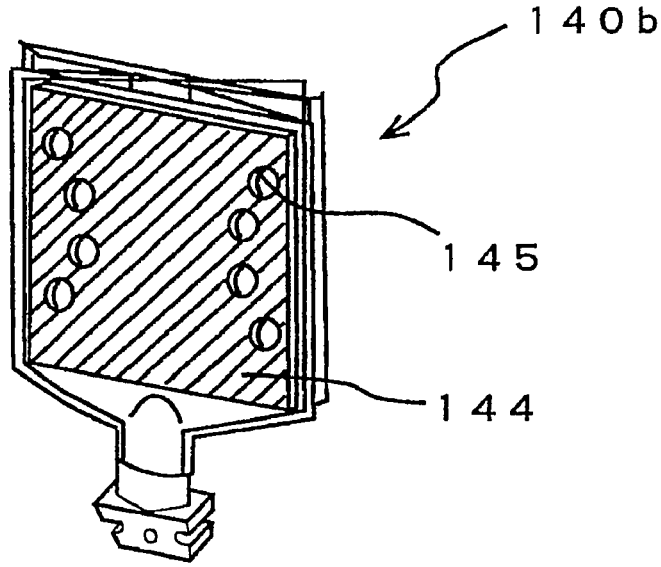
FIG.14B RELATED ART
FIG. 14B is an external perspective view of the container after the contents are used.
Figure 15A:
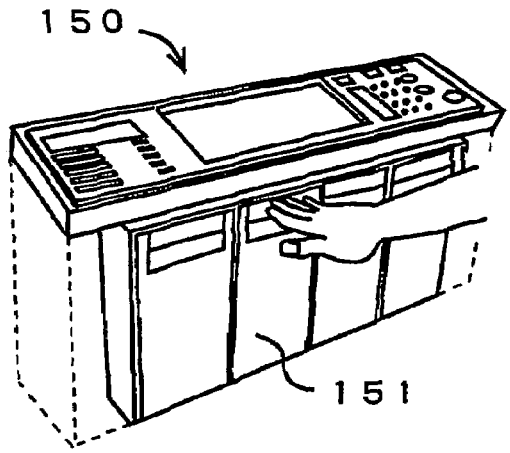
FIGS. 15A to 15C are drawings of a method of inserting the container in a copying machine.
Figure 15B:
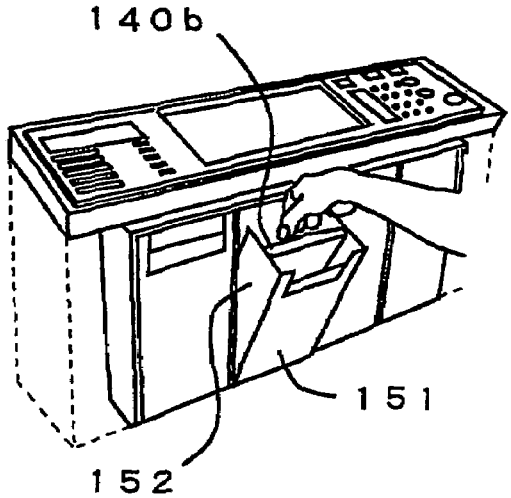
Figure 15C:
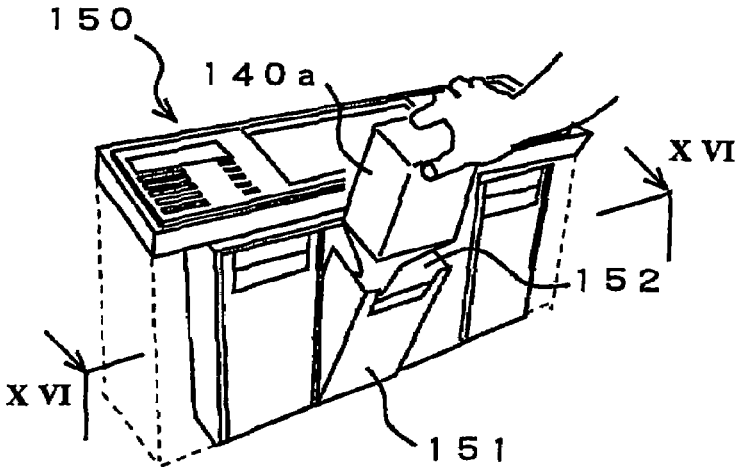
Figure 15D:
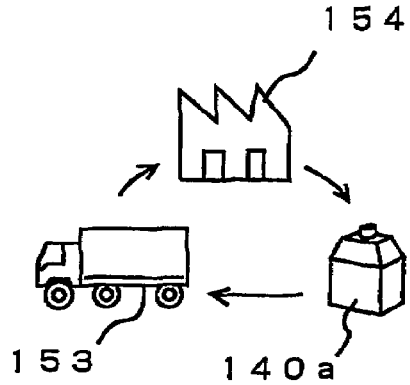
FIG. 15D is a drawing of toner recycling.
Figure 16:
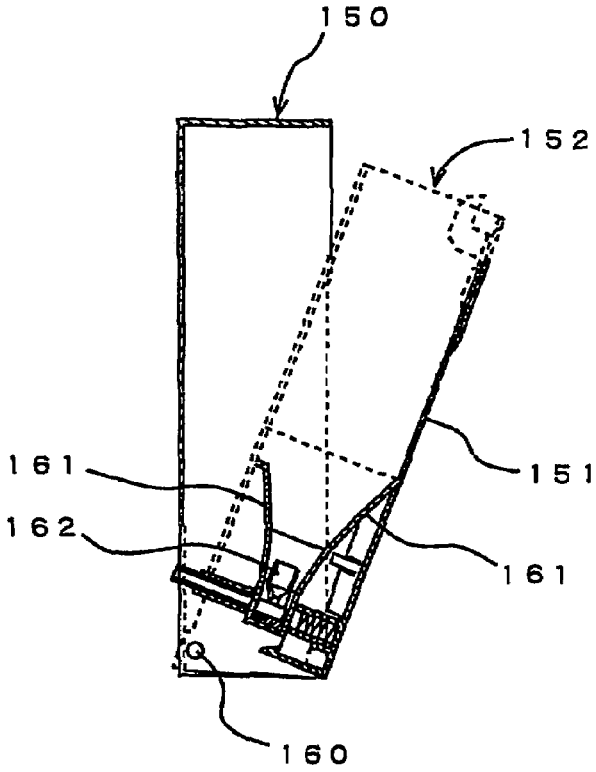
FIG. 16 is a section view of the copying machine in a XVI-XVI,line shown in FIG. 15C.
Figure 17:
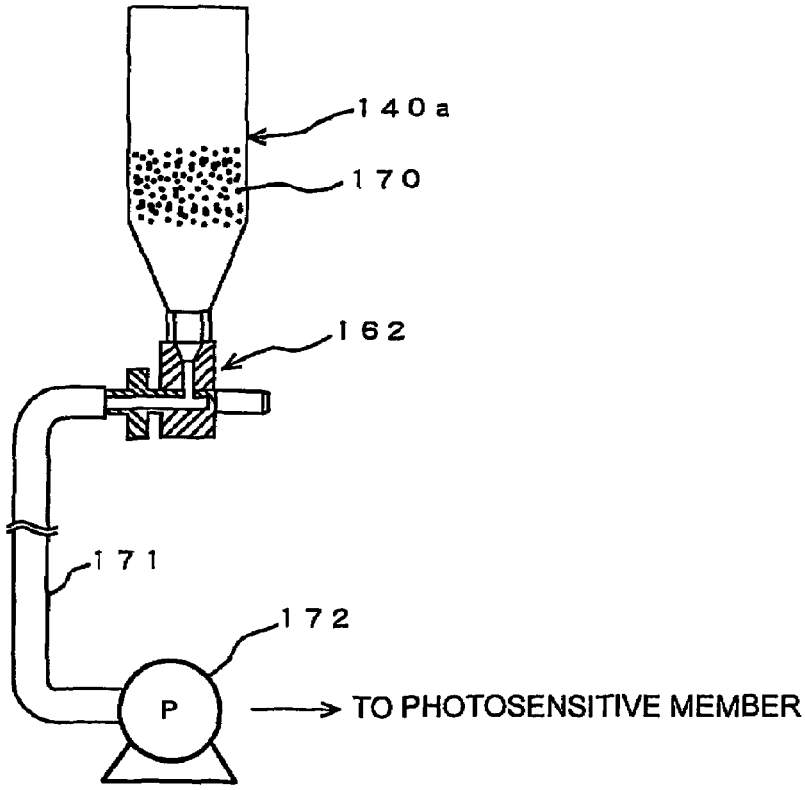
FIG. 17 is a drawing of the state where the toner as the contents is sucked from the container into the copying machine.

To accommodate the container 140*a* (refer to FIG. 14), the packaging box 100 presses the external surface of the container 140*a*with at least the first wall portion 11 (in the drawing, a bottom-surface member) and the second wall portion 12 (in this case, an upper-surface member) opposed to the first wall portion, and also fixes the container 140*a* with friction.

Therefore, a tilt angle between the first wall portion 11 and the second wall portion 12 and the size of each of the wall portions 11 to 16 are set to the extent that, when accommodating the container 140*a*, the packaging box can press the container 140*a* with at least the first wall portion 11 and the second wall portion 12 and can fix the container with friction.

Here, "at least" means that the packaging box may press the container 140*a* with, in addition to the first wall portion 11 and the second wall portion 12, a wall portion (or a chamfered surface) including any of the third wall portion 13, the fourth wall portion 14, the fifth wall portion 15, and the sixth wall portion 16.

The packaging box 100 has its surface of the second wall portion 12 provided with a note, such as "This side is top surface", so that the second wall portion 12 faces out.

The section in the Ib-Ib line of the packaging box 100 has a rectangular shape as shown in FIG. 1B. However, this is not meant to restrict the present invention. The section may have the rectangular shape shown in FIG. 1B with its upper two vertices being chamfered (FIG. 1C), the rectangular shape shown in FIG. 1B with its lower two vertices being chamfered (FIG. 1E), the rectangular shape shown in FIG. 1B with its four vertices being chamfered (FIG. 1D), a trapezoidal shape (FIG. 1F), or an elliptical shape.

FIG. 2 is a drawing that depicts a net for the packaging box shown in FIG. 1A.

This packaging box 100 is made of a single plate-like member (for example, corrugated cardboard paper or corrugated cardboard resin).

The trapezoidal first wall portion 11 has one of parallel sides that is shorter, that is, a side L1, being connected to the rectangular sixth wall portion 16. A side L2 of the sixth wall portion 16 opposed to the side L1 thereof is connected to one of parallel sides that is shorter, that is, a side L3, of the trapezoidal second wall portion 12. The side L3 of the second wall portion 12 is connected to the rectangular third wall portion 13. The side L3 between the second wall portion 12 and the third wall portion 13 serves as a hinge to allow the third wall portion 13 to freely rotate. Therefore, the third wall portion 13 can be open.

The first wall portion 11 also has sides L4 and L5 in a direction (in this case, in a horizontal direction) perpendicular to its connecting direction (in the drawing, a vertical direction), these sides being connected to sides opposed to hypotenuses L6 and L7 of the approximately trapezoidal fourth and sixth wall portions 14 and 16, respectively. At the center of the fourth wall portion 14, a crease 21 is formed to be opposed to the side L4 and the hypotenuse L6. At the center of the fifth wall portion 15, a crease 22 is formed to be opposed to the side L5 and the hypotenuse L7.

On the other hand, the second wall portion 12 has a side L8 (which becomes the side L6 when folded) and a side L9 (which becomes the side L7 when folded) in a direction perpendicular to its connecting direction, these sides being connected to overlap portions 23 and 24 for pasting.

The overlap portions 23 and 24 for pasting are formed so that sides L20 and L21 of the overlap portions 23 and 24 approximately coincide with the creases 21 and 22., respectively, when folded.

A side L23 of the first wall portion 11 is connected to a folding strip 27 being foldable and provided on a folding line (side L23) with insertion openings 25 and 26.

A side L24 opposed to the side L3 of the third wall portion 13 is connected to an insertion strip 28 extending from the third wall portion 13, the insertion strip 28 being foldable and insertable in the insertion openings 25 and 26 when folded.

From the first wall portion 11 to the folding strip 27, a slit having an inverted U shape is formed across the insertion openings 25 and 26 when folded, the slit serving as a foldable anti-opening strip 29.

Here, the insertion openings 25 and 26 each have a slit shape. When the anti-opening strip 29 is lifted from the first wall portion 11 and the folding strip 27, these insertion openings 25 and 26 are connected to each other to allow the insertion strip 28 to be inserted therein.

However, when the packaging box 100 (refer to FIG. 1A) is not formed with the anti-opening strip 29 or another insertion opening 30 and therefore requires a tape or the like for packaging, it goes without saying that the insertion openings 25 and 26 are integrally formed as a single slit.

On the folding line L24 between the third wall portion 13 and the insertion strip 28, the other insertion opening 30 is formed where the anti-opening strip is to be inserted. The other insertion opening 30 is a hole having a slit notched on both ends with an approximately semicircular hole (in the drawing, the hole is a semicircle, but may be a semi-polygon, triangle, or semi-ellipse). When the anti-opening strip 29 is inserted in the insertion opening 30 when folding, the notches prevent the anti-opening strip 29 from falling off Also, when the container 140*a* is extracted from the packaging box 100 (refer to FIG. 1A), the user can easily touch the anti-opening strip 29 with fingers for lifting.

Perforations M1 to M4 each having a predetermined length (for example, four centimeters) are provided on the side L4 between the first wall portion 11 and the fourth wall portion 14, the side L8 (the side L6 when folded) between the second wall portion 12 and the fourth wall portion 14, the side L9 (the side L7 when folded) between the second wall portion 12 and the fifth wall portion 15, and the side L5 between the first wall portion 11 and the fifth wall portion 15, respectively, each perforation being near the third wall portion 13.

Here, when the plate-like member is made of a corrugated cardboard, the plate-like member is structured so that its flute direction is parallel to the connecting direction of the first wall portion 11, the second wall portion 12, and the third wall portion 13. This improves strength of the packaging box 100 such that it is less prone to be deformed even if the container 140*a* is expanded due to a drop in barometric pressure during transportation, thereby preventing the third wall portion 13 from being open by itself.

A slit 31 is formed to extend from the side L6 of the sixth wall portion 16 in a direction away from the first wall portion 11 and to serve as a lingulated strip 31 having an approximately rectangular shape (alternatively, a shape of U, semi-polygon, or triangle).

Here, 14*a* and 15*a* denote auxiliary strips for preventing the third wall portion 13 of the packaging box 100 from being bent toward the packaging box 100 when closed.

Figure 3A:
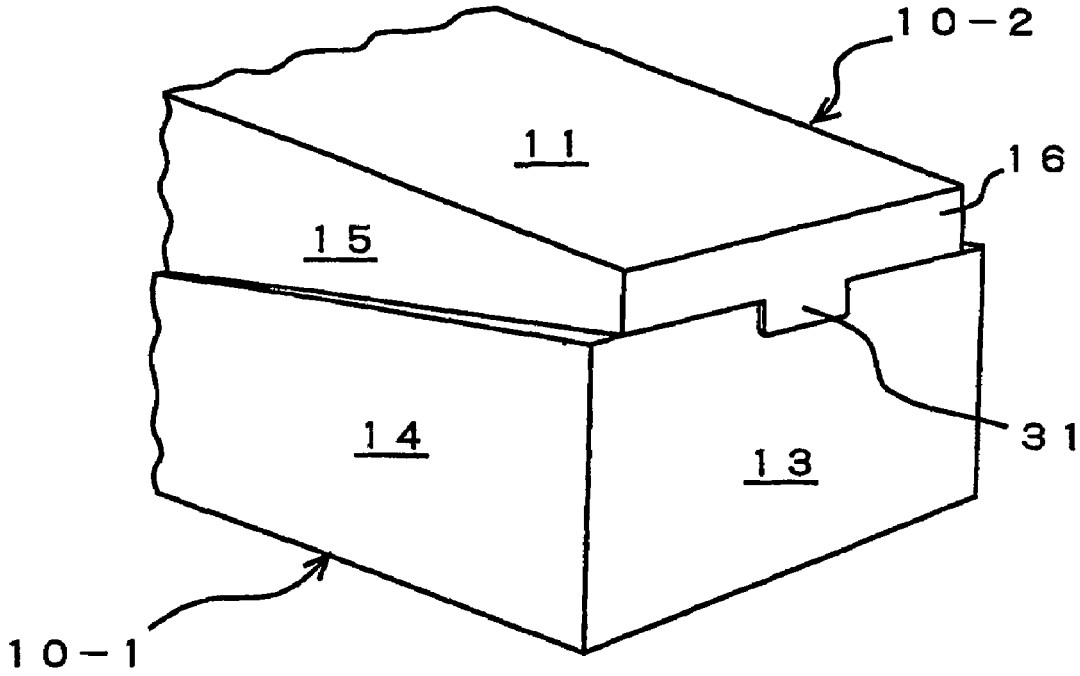
FIG. 3A is an external perspective view of a portion near the lingulated strip viewed from a sixth wall portion of the packaging box when the net shown in FIG. 2 is folded.
Figure 3B:
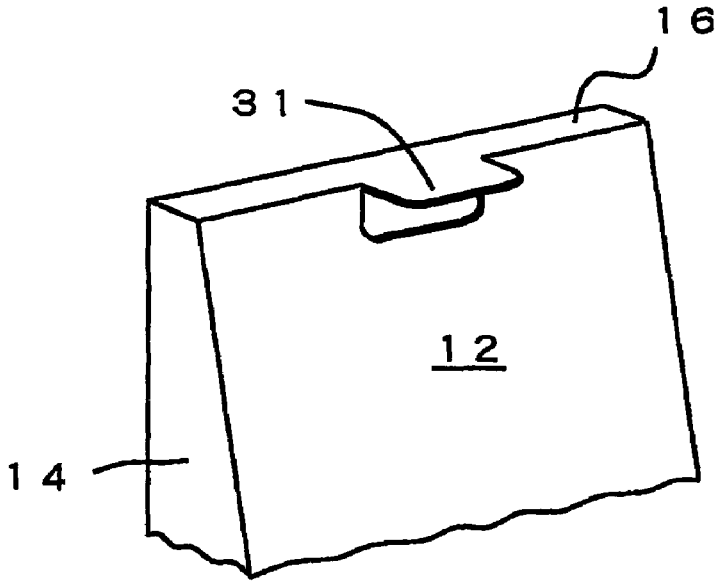
FIG. 3B is an external perspective view of a portion near the lingulated strip viewed from a second wall portion when the net shown in FIG. 2 is folded.

FIG. 3A is an external perspective view of a portion near the lingulated strip viewed from the sixth wall portion of the packaging box when the net shown in shown in FIG. 2 is folded. FIG. 3B is an external perspective view of a portion near the lingulated strip viewed from the second wall portion when the net shown in FIG. 2 is folded.

The packaging box 100 includes the lingulated strip 31. With this, a packaging box 10-1 is placed with its first wall portion 11 being at, bottom and another packaging box 10-2 is placed with its first wall portion 11 at top (these packaging boxes are placed so that their second wall portions 12 face each other), with the lingulated strip 31 being hooked on the third wall portion 13 of the packaging box 10-1. With this, the packaging box 10-2 can be placed without sliding from the packaging box 10-1.

The sixth wall portion 16 has a dimension to be able to have character information (for example, a toner color or model number of the copying machine) recognizable by the naked eye (for example, a font size of 12 points or larger).

(Operational Effects)

The packaging box 100 shown in FIG. 1 presses the container body 141 of the container 140*a* with the first wall portion 11, the second wall portion 12, the third wall portion 13, the fourth wall portion 14, and the fifth wall portion 15, and also fixes the container with friction. Therefore, no cushion material is required. This can prevent compressive buckling of the neck portion 143 and the occurrence of wrinkles.

With the second wall portion 12 being tilted toward the first wall portion 11, the neck portion 143 of the container 140*a* is prevented from being placed to a narrower portion of the packaging box 100. That is, the sixth wall portion 16 is prevented from being oriented downward. Therefore, the toner in the container 140*a* can be prevented from being solidified near the shoulder portion 142.

The first wall portion 11 and the second wall portion 12 are connected to the third wall portion 13, the fourth wall portion 14, the fifth wall portion 15, and the sixth wall portion 16. Also, the third wall portion 13 connected to the side L23 opposed to the crossline 17 where the extended plane of the first wall portion 11 and the extended plane of the second wall portion 12 cross can be open. Therefore, the container 140*a* can be easily accommodated.

With the first wall portion 11 and the third wall portion 13 being perpendicular to each other, the packaging box 100 can be placed with ease in landscape orientation. Also, packaging boxes can be vertically stacked with ease. Therefore, the packaging box according to the present invention is easier to be open than the conventional packaging box having a rectangular parallelepiped.

The fourth wall portion 14 and the fifth wall portion 15 are provided to be connected to the three wall portions of the first wall portion 11, the second wall portion 12, and the third wall portion 13. Also, the fourth wall portion 14 and the fifth wall portion 15 are formed to be tapered in a direction away from the third wall portion 13. Therefore, the box can be easily folded by itself. Furthermore, when a plurality of packaging boxes are placed in parallel, alternate steps appear on their surfaces (refer to FIG. 7A). Therefore, these packaging boxes can be easily extracted individually even they are in an accumulated state. Still further, the packaging boxes 100 can be stacked even with the third wall portion 13 being open, thereby achieving space saving.

Figure 7A:
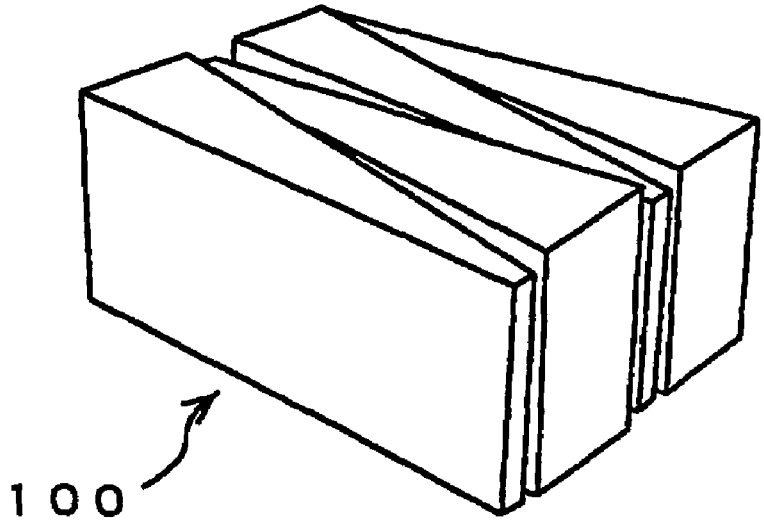
FIG. 7A is a drawing of the state where a plurality of packaging boxes shown in FIG. 1A are placed in landscape orientation.
Figure 7B:
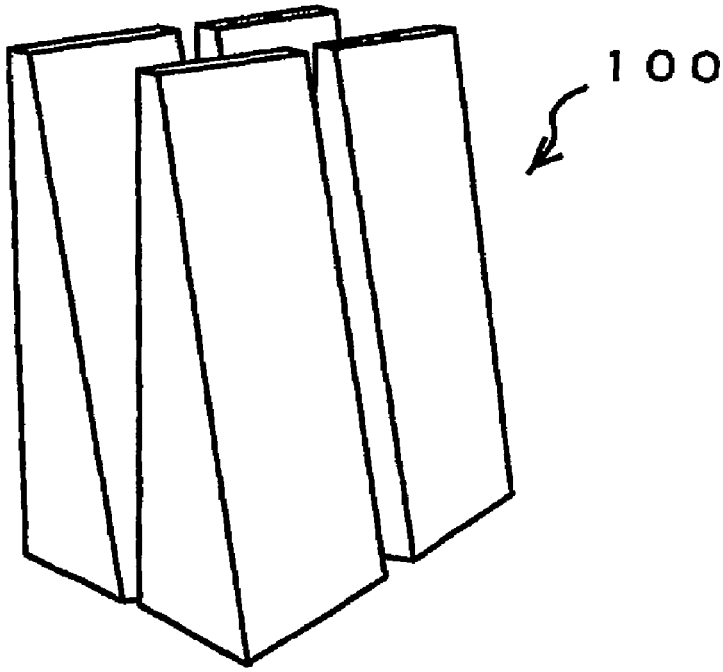
FIG. 7B is a drawing of the state where the packaging boxes shown in FIG. 1A are placed in portrait orientation.

Here, FIG. 7A is a drawing of the state where the packaging boxes shown in FIG. 1A are placed in landscape orientation and FIG. 7B is a drawing of the state where the packaging boxes shown in FIG. 1A are placed in portrait orientation.

The four walls of the first wall portion 11, the second wall portion 12, the fourth wall portion 14, and the fifth wall portion 15 are connected one another near the crossline 17 (refer to FIG. 1A). Also, the sixth wall portion 16 is provided to be opposed to the third wall portion 13. Furthermore, the fourth wall portion 14 has a dimension to be able to have character information recognizable by the naked eye. With this, such information can be shown even when the packaging boxes 100 are stacked, thereby preventing the user from placing them with their sixth wall portion 16 at bottom. That is, the occurrence of solidification because the neck portion 143 of the container 140*a* accommodated in the packaging box 100 is oriented downward can be prevented (refer to FIG. 7B).

As has been described above, the lingulated strip 31 extending from the sixth wall portion 16 in a direction away from the first wall portion 11 can prevent slipping when two packaging boxes 100 are vertically stacked. Also, the lingulated strip 31 can serve as a hook for extraction with fingers when the packaging boxes 100 are placed in landscape orientation.

The fourth wall portion 14 and the fifth wall portion 15 are provided with the creases 21 and 22, respectively, serving as guides for folding the second wall portion 12 toward the first wall portion 11. Therefore, as with the container 140*a*, the packaging box 100 can also be flatly crushed. Therefore, the packaging box 100 itself or the packaging box 100 having accommodated therein the vacant container 140*b* (refer to FIG. 14B) can be collected and destroyed with high space efficiency.

The side between the second wall portion 12 and the third wall portion 13 serves as a hinge to allow the third wall portion 13 to freely rotate. Therefore, the container 140*a* can be smoothly extracted with the side L3, which allows easy opening, at top.

If the note is shown on the surface of the second wall portion 12 that faces out, the note can be visually recognized by users with ease and without inconvenience even when the packaging boxes 100 are placed in landscape orientation (refer to FIG. 7A) or in portrait orientation (refer to FIG. 7B).

If descriptions including how to remove the contents (in this case, toner) are shown on the outer surface of the first wall portion 11, the operation procedure can be reliably conveyed to the user since the user naturally places the first wall portion 11 upward at the time of opening.

If the note is shown on the third wall portion 13 so that the side L3 between the second wall portion 12 and the third wall portion 13 is placed upward with respect to the first wall portion 11. With this, when the user places the packaging box 100 in landscape orientation, the note shown on the third wall, portion 13 can be vertically oriented so as to be easily read.

The packaging box 100 is made of a single folded plate-like member. Therefore, easy manufacturing and cost reduction can be expected. Also, the overlap portions 23 and 24 for pasting provided on the plate-like member have dimensions so that the sides of the overlap portions 23 and 24 approximately coincide with the creases 21 and 22, respectively, when the plate-like member is folded to form the packaging box 100. Therefore, the strength of the packaging box 100 can be maintained. Also, when the packaging box 100 is collected with the vacant container 140*b* being accommodated therein, that is, the crushed packaging box 100 is used as a returnable box, the fourth wall portion 14 and the fifth wall portion 15 are folded along the creases 21 and 22, which makes a packaging operation easier.

When the plate-like member is made of a corrugated cardboard, the plate-like member is structured so that its flute direction is parallel to the connecting direction of the first wall portion 11, the second wall portion 12, and the third wall portion 13. This improves strength of the packaging box 100 such that it is less prone to be deformed when, for example, transported by air with the container 140*a* being accommodated therein or when transported to a highland where barometric pressure is lowered. Thus, occasions of unnecessary opening (self-opening) of the packaging box can be reduced.

With the folding strip 27 and the insertion strip 28, the packaging box 100 is less prone to be deformed even with expansion of the container 140*a* due to a drop in barometric pressure, thereby reducing occasions of unnecessary opening.

With the anti-opening strip 29 and the other insertion opening 30, the packaging box 100 is less prone to be deformed even with expansion of the container 140*a* due to a drop in barometric pressure, thereby reducing occasions of unnecessary opening.

The packaging box 100 is provided on the sides L4 to L7 with the perforations M1 to M4 each having a predetermined length near the third wall portion 13. Therefore, the user can tear the packaging box 100 along the perforations M1 to M4 for a length that allows the container 140*a* to be easily extracted from the packaging box 100.

Next, an example of the case where the packaging box 100 is used as a box for collecting the vacant container 140*b* is described with reference to FIGS. 8 to 13.

Figure 8:
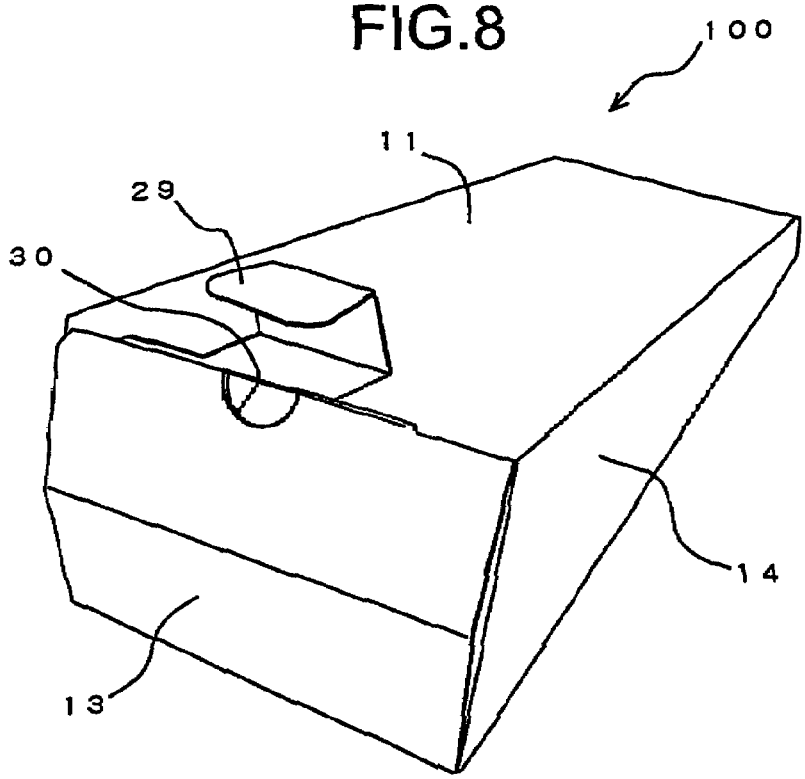
FIG. 8 is a drawing of the state where an anti-opening strip of the packaging box shown in FIG. 1A is away from an insertion opening.

FIG. 8 is a drawing of the state where the anti-opening strip of the packaging box shown in FIG. 1A is away from the other insertion opening.

Figure 9:
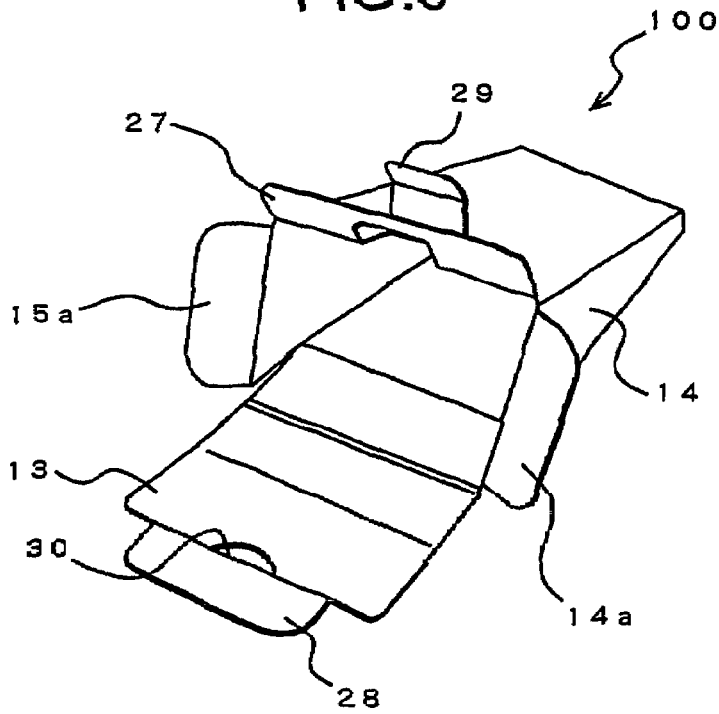
FIG. 9 is a drawing of the state where a folding strip, a third wall portion, and auxiliary strips shown in FIG. 1A are open.

FIG. 9 is a drawing of the state where the folding strip, the third wall portion, and the auxiliary strips shown in FIG. 1A are open.

Figure 10:
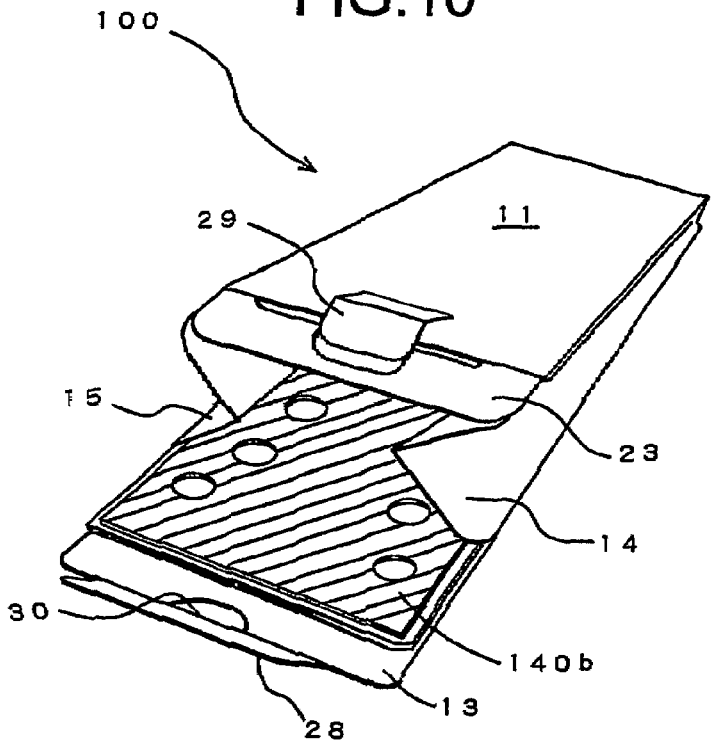
FIG. 10 is a drawing of the state where the packaging box shown in FIG. 1A is slightly crushed with a vacant container being accommodated therein.

FIG. 10 is a drawing of the state where the packaging box shown in FIG. 1A is slightly crushed with a vacant container being accommodated therein.

Figure 11:
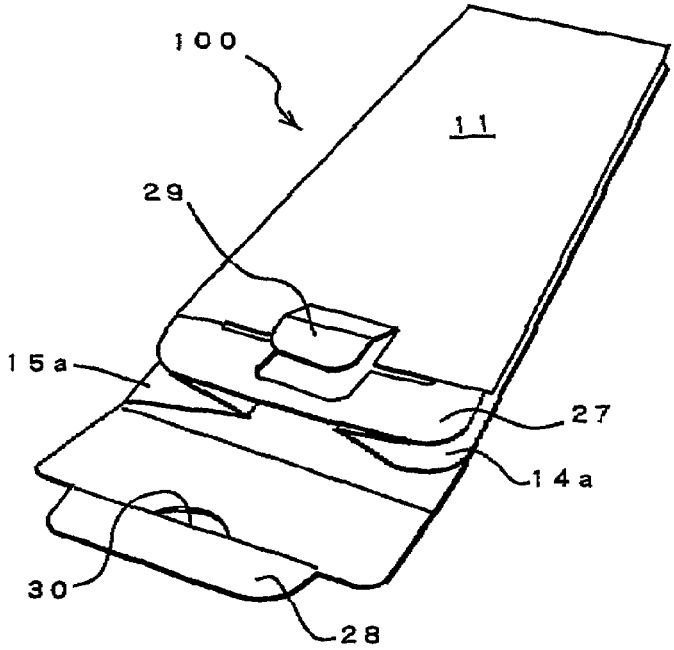
FIG. 11 is a drawing of the state where the packaging box shown in FIG. 1A is crushed.

FIG. 11 is a drawing of the state where the packaging box shown in FIG. 1A is crushed.

Figure 12:
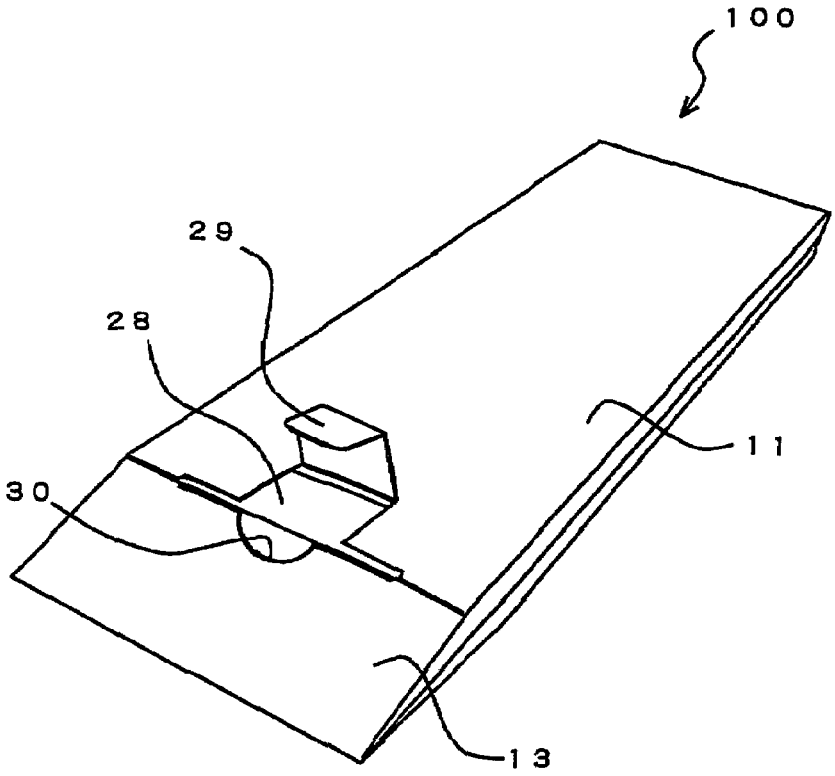
FIG. 12 is a drawing of the state immediately before the anti-opening strip of the packaging box shown in FIG. 1A is inserted in the insertion opening.

FIG. 12 is a drawing of the state immediately before the anti-opening strip of the packaging box shown in FIG. 1A is inserted in the insertion opening.

Figure 13:
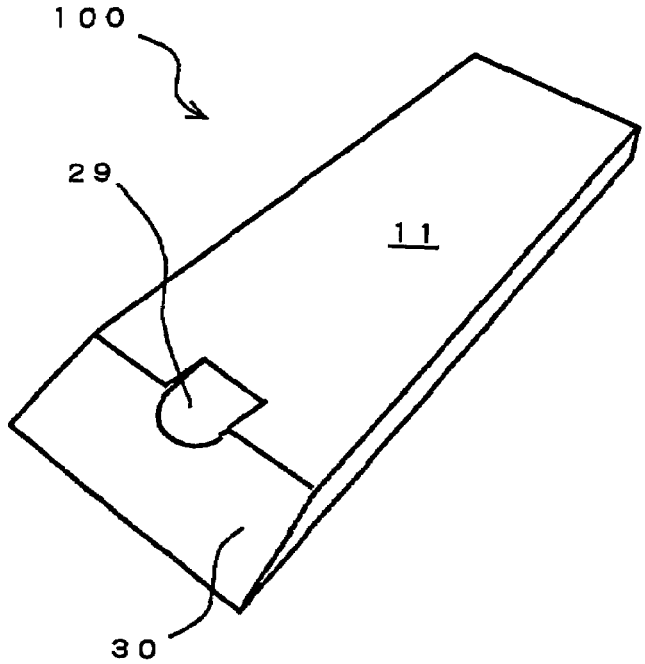
FIG. 13 is a drawing after the anti-opening strip of the packaging box shown in FIG. 1A is inserted in the insertion opening.

FIG. 13 is a drawing of the state after the anti-opening strip of the packaging box shown in FIG. 1A is inserted in the insertion opening.

First, the anti-opening strip 29 of the packaging box 100 is lifted (FIG. 8).

Next, the third wall portion 13 is pulled down, the folding strip 27 is pulled up, and then the auxiliary strips 14*a* and 15*a* are extended horizontally (FIG. 9).

Next, the vacant container 140*b* is accommodated in the packaging box 100 in a manner similar to that when the container 140*a* filled with the toner is accommodated, such that the neck portion 143 is first inserted (FIG. 10).

After the container 140*b* is accommodated in the packaging box 100, the third wall portion 13 is folded along a crease L10 of the third wall portion 13 toward the first wall portion 11 (FIG. 11).

Next, the anti-opening strip 29 is inserted in the insertion opening 30 (FIG. 12).

With the anti-opening strip 29 being inserted in the insertion opening 30, the vacant container 140*b* can be accommodated in the packaging box 100 for transportation to a factory without using tapes or adhesives. At this time, a destination address for collection, for example, is preferably shown in advance on the packaging box 100 (FIG. 13).

Figure 4:
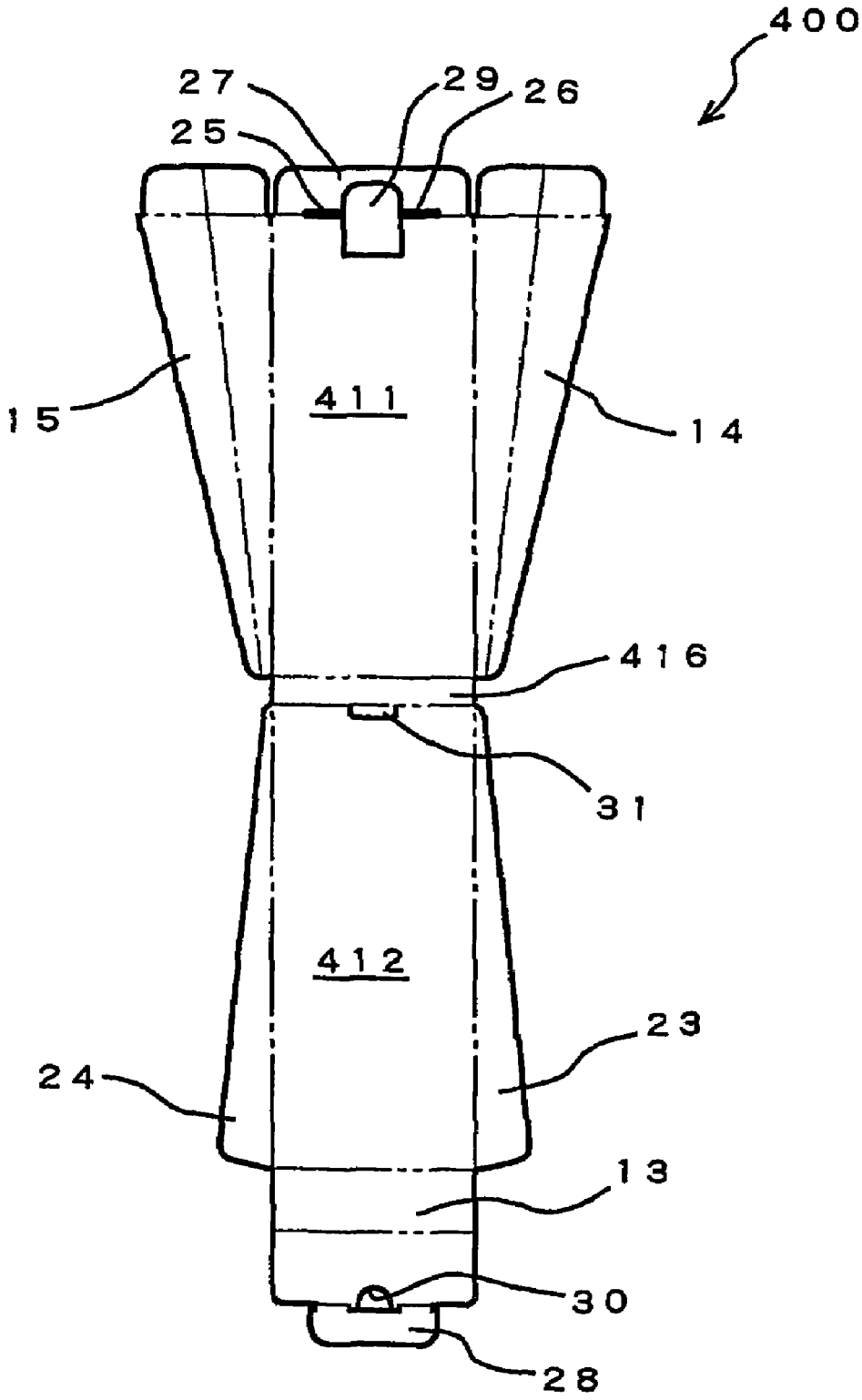
FIG. 4 is a drawing that depicts a net for another embodiment of the packaging box according to the present invention.

FIG. 4 is a drawing that depicts a net for another embodiment of the packaging box according to the present invention.

This embodiment is different from the embodiment shown in FIG. 2 in that a first wall portion 411 and a second wall portion 412 each have a rectangular shape.

The packaging box based on a net 200 shown in FIG. 2 has an approximately prismoidal external shape. However, the first wall portion 411 and the second wall portion 412 are not tapered but are parallel to each other. Thus, effects approximately similar to those achieved by the packaging box 100 shown in FIG. 1A can be achieved. However, when packaging boxes each based on a net 400 shown in FIG. 4 are placed as shown in FIG. 7A, the heights of the packaging boxes are the same. Therefore, it will take time in some degree to individually extract them.

Figure 5:
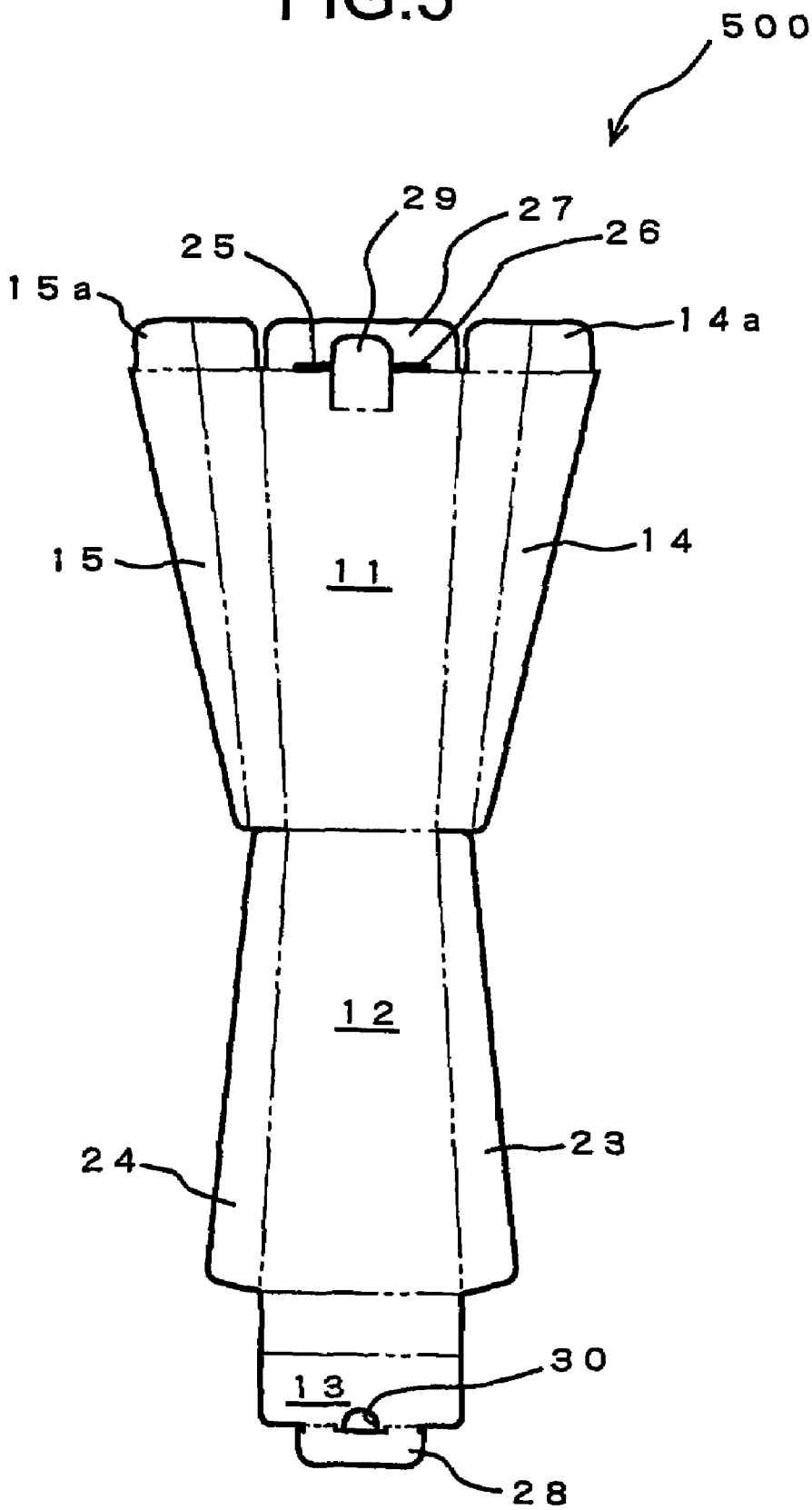
FIG. 5 is a drawing that depicts a net for still another embodiment of the packaging box according to the present invention.
Figure 6:
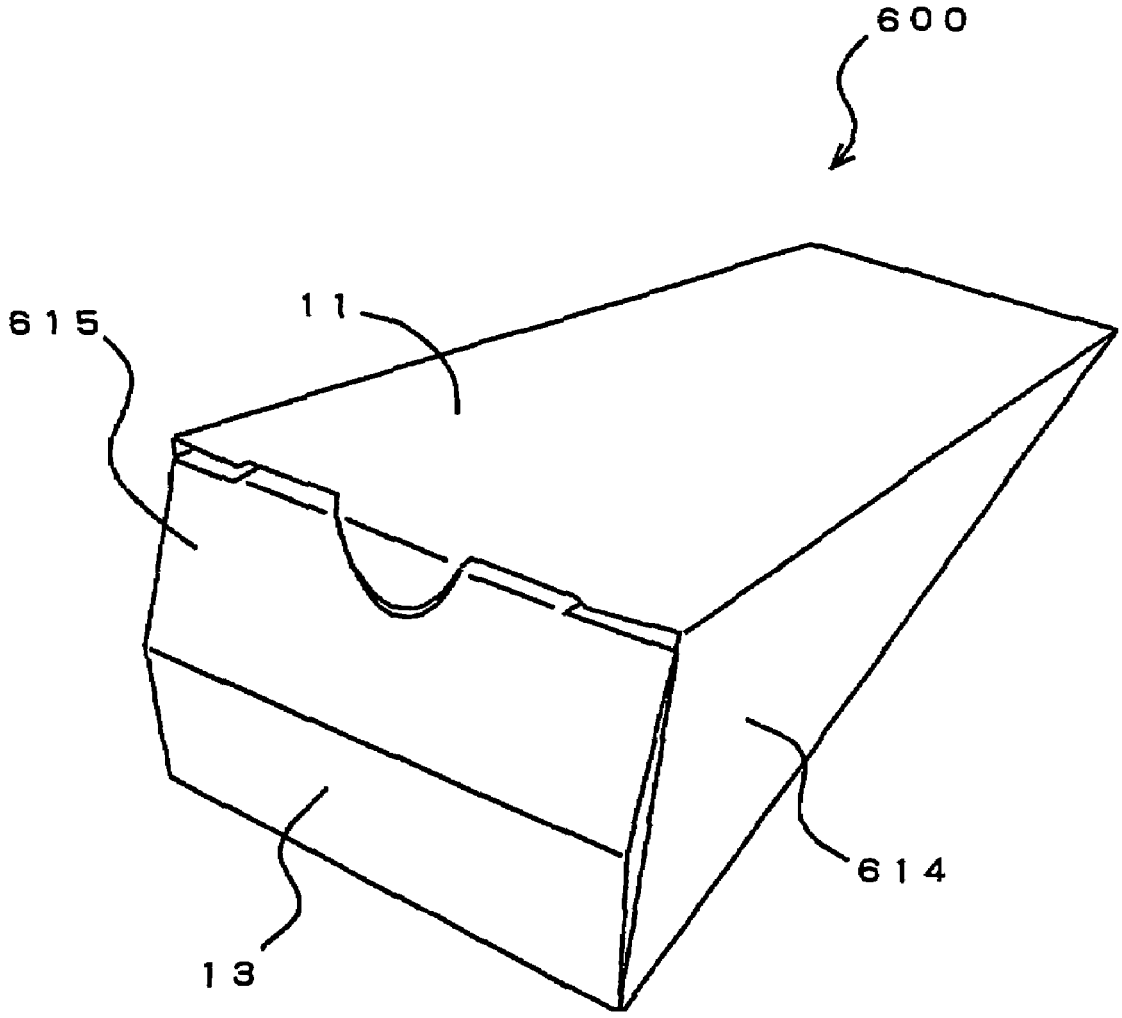
FIG. 6 is an external perspective view of the packaging box based on the net shown in FIG. 5.

FIG. 5 is a drawing that depicts a net for still another embodiment of the packaging box according to the present invention. FIG. 6 is an external perspective view of the packaging box based on the net shown in FIG. 5.

This embodiment is different from the embodiment shown in FIG. 2 in that no sixth wall portion 16 (refer to FIG. 2) or lingulated strip 31 are present.

A packaging box 600 based on a net 500 shown in FIG. 5 has a wedge-like external shape. Thus, effects approximately similar to those achieved by the packaging box 100 shown in FIG. 1A can be achieved. However, without the lingulated strip 31, the packaging box 600 does not have a member for preventing slipping when two packaging boxes 100 are vertically stacked or a hook for extraction with fingers when the packaging boxes 100 are placed in landscape orientation.

As described above, according to the present invention, the external surface of a shrinkable container filled with the contents is pressed by the first wall portion and the second wall portion opposed to the first wall portion. Also, the container is fixed with friction. Therefore, it is possible to achieve provision of a packaging box that can transport a shrinkable container filled with contents without deforming the container or using a cushion material.

In the present embodiments, description has been made to the case where the contents are toner. This is not meant to restrict the present invention. The present invention may be applied to gas, liquid, or powders, for example.

The packaging box according to the present invention presses the external surface of the shrinkable container filled with contents with the first wall portion and the second wall portion opposed to the first wall portion, and also fixes the container with friction. Therefore, an effect can be achieved that allows transportation of the container without deformation of the container or use of a cushion material.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

INDUSTRIAL APPLICABILITY

As has been described above, the packaging box according to the present invention is useful for accommodating a shrinkable container, and is particularly suitable for accommodating such a container filled with contents for transportation.

The invention claimed is:

1. A packaging box comprising:

at least a first wall portion and a second wall portion opposed to the first wall portion, wherein a shrinkable container filled with contents can be sandwiched between the first wall portion and the second wall portion whereby the shrinkable container can be held firmly between the first wall portion and the second wall portion due to a frictional force between an external surface of the shrinkable container and internal surfaces of the first wall portion and the second wall portion, a connection between the first wall portion and the second wall portion being continuous without an opening therein, wherein the first wall portion and the second wall portion are connected to each other with at least three wall portions, and, a third wall portion connected to a side opposed to a crossline between an extended plane of the first wall portion and an extended plane of the second wall portion can be opened by removing an anti-opening strip from an insertion opening, wherein a fourth wall portion and a fifth wall portion are provided to be connected to three wall portions of the first wall portion, the second wall portion, and the third wall portion, and the fourth wall portion and the fifth wall portion are tapered in a direction away from the third wall portion, wherein the packaging box is made of a single folded plate member, at least the first wall portion, the second wall portion, and the third wall portion are sequentially connected when developed into the packing box, the fourth wall portion and the fifth wall portion are connected to both sides of the first wall portion, and overlap portions for pasting the fourth wall portion and the fifth wall portion together are connected to both sides of the second wall portion, each overlap portion being formed so that a side of the overlap portion approximately coincides with a crease serving as a guide for folding the second wall portion toward the first wall portion.

2. The packaging box according to claim 1, wherein the plate member is made of a corrugated cardboard, and a flute direction of the plate member is parallel to a connecting direction of the first wall portion, the second wall portion, and the third wall portion.

3. The packaging box according to claim 1, wherein:

the anti-opening strip extends from the first wall portion toward a folding strip to go across the insertion opening and is formed to be folded, the packaging box further comprising:

another insertion opening in which the anti-opening strip is inserted, the another insertion opening being provided on a crease between the third wall portion and an insertion strip, wherein when the anti-opening strip has been inserted into the another insertion opening, the anti-opening strip is exposed from a side surface of the third wall portion.

4. The packaging box according to claim 3, wherein:

when the shrinkable container is removed from the packaging box, a user has access to the anti-opening strip for lifting.

* * * * *